United States Patent [19]

McKibben et al.

[11] Patent Number: 4,643,243

[45] Date of Patent: Feb. 17, 1987

[54] MACHINE FOR IMPACT CLEANING CASTING

[75] Inventors: Kenneth D. McKibben, Defiance, Ohio; Alan P. Gould, Au Gres, Mich.; Craig J. Groh, Standish, Mich.; Thomas E. Wuepper, Alger, Mich.

[73] Assignee: Seaton-SSK Engineering Co., Inc., Au Gres, Mich.

[21] Appl. No.: 762,540

[22] Filed: Aug. 5, 1985

[51] Int. Cl.[4] ..... B22D 27/08

[52] U.S. Cl. ..... 164/260; 164/404; 164/344

[58] Field of Search ..... 164/260, 344, 404, 416, 164/261; 173/128

[56] References Cited

U.S. PATENT DOCUMENTS

| | | | |
|---|---|---|---|
| 1,908,104 | 5/1933 | Bell | 164/260 X |
| 2,004,293 | 6/1935 | Piper | 164/261 X |
| 2,353,492 | 7/1944 | O'Connor | 164/260 X |
| 2,555,688 | 6/1951 | Flam | 164/260 X |
| 3,749,151 | 7/1973 | George et al. | 164/260 |

*Primary Examiner*—James M. Meister
*Assistant Examiner*—John L. Knoble
*Attorney, Agent, or Firm*—Cullen, Sloman, Cantor, Grauer, Scott and Rutherford

[57] ABSTRACT

A machine for repeatedly impacting metal castings in order to clean the castings of debris, such as sand, is formed of a wheel-like frame which is rotatably mounted upon a horizontal axle. The frame is divided into four equally spaced apart compartments which provide two pair of opposed compartments. The radially innermost wall of each compartment is formed of a metal plate arranged parallel to the axle so that the plate of the uppermost compartment is horizontal and forms a floor-like support for the casting which is then located in that compartment. Each plate is loosely supported upon springs and has an exposed end portion that extends transversely outwardly of the frame. An impact hammer is arranged to repeatedly apply blows that are directed radially towards the axle against the exposed end portion of the uppermost plate for vibrating the plate and for transmitting the forces of the blows to the casting for loosening debris clinging thereto. An endwise slidable bar extends through the plates of each pair of compartments so that a casting that is moved horizontally into a compartment physically pushes its bar endwise to push the casting in the opposed compartment horizontally outwardly of the frame for horizontally loading and unloading the castings.

15 Claims, 6 Drawing Figures

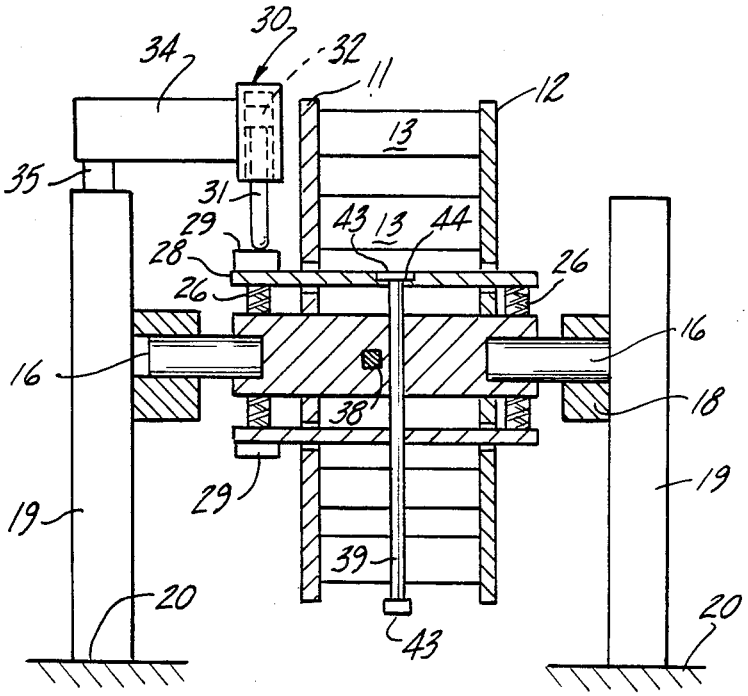
Fig-3
Fig-5
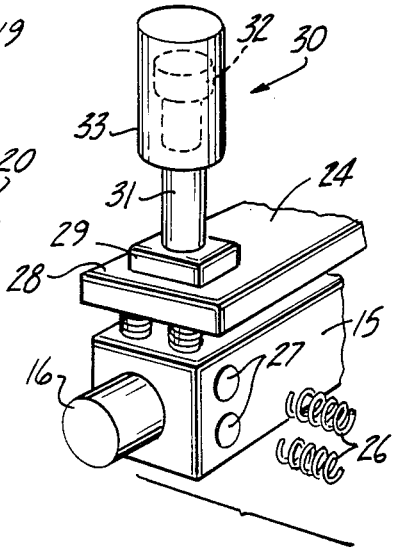
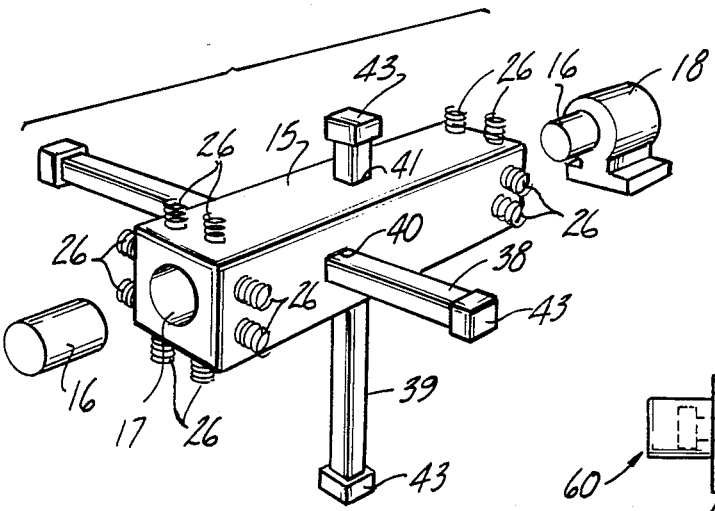
Fig-4
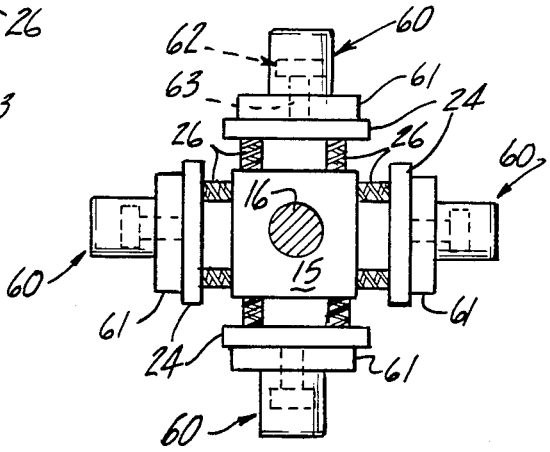
Fig-6

MACHINE FOR IMPACT CLEANING CASTING

BACKGROUND OF DISCLOSURE

In the conventional process of casting metal parts in said molds, when the castings are removed from the molds, some debris usually remains with the casting. That is, when the sand molds are broken open and the castings removed, sometimes some sand will stick to the interior or exterior walls surfaces and, in some cases, bits of metal, broken portions of cores and the like also adhere to the metal. Thus, it is usually necessary to clean the casting immediately after it is removed from the sand mold and before any machining is performed.

Conventionally, castings have been cleaned manually. That is, an individual worker has been required to remove debris by brushing, blowing compressed air upon the casting and in some cases impacting against particularly tenacious debris sticking to the casting. Such manual cleaning is relatively slow, requires considerable labor, and is difficult to perform. Where castings are produced on a mass production basis, such as large quantities of engine block castings for automotive engines or similar types of metal parts, a more mechanized, automatic and more effective system of cleaning is needed. The invention herein relates to such an apparatus.

SUMMARY OF THE INVENTION

The invention herein contemplates an apparatus for cleaning debris sticking to castings, by supporting each casting upon a spring mounted plate which is repeatedly impacted so that the impact forces are spread out over the casting for loosening and removing the debris. The apparatus is particularly adapted for high volume, mass production cleaning of castings such as engine blocks and the like which are produced in sand molds and must be rapidly cleaned following the casting operation in order to proceed to a machining operation. For this purpose, the apparatus contemplates a wheel-like frame which rotates about a horizontal axis. The frame is divided into opposing pairs of compartments which receive a casting from one direction and thereafter rotate so that the casting rests upon the loose, impacted plate for a short time for repeatedly applying impacts to the casting. Then the frame is rotated into a position for removal of the cleaned casting.

Thus, an object of this invention is to provide a machine which is formed, like a wheel rotating about a horizontal axle, to receive horizontally moving castings from a conveyor, rotate the casting so that it rests upon the spring supported impact plate which distributes the impact forces throughout casting. Thereafter, the frame is rotated into a position from which the clean casting can be horizontally moved to the next treating operation. It is also contemplated to include in these compartments a pusher rod wherein a horizontally moving casting arriving in one compartment simultaneously exerts a force through the pusher rod to remove the casting located in its opposing compartment.

One object of this invention is provide a simplified apparatus, having few moving parts, and which can be built ruggedly to sustain repeated impacts and vibrations, and which will rapidly impact and vibrate a casting in such a way that the forces are disbursed throughout the casting and are not concentrated. Thus, damage to the casting, which could be caused by localized forces or stresses, is avoided by spreading out the impact loads.

Still a further object of this invention is to provide an apparatus which is essentially open so that a casting which is under impact and vibration for loosening its debris, is exposed sufficiently so that compressed air or pressurized fluid may be directed against it for better cleaning. The openness of the equipment prevents accumulation of the removed debris within the equipment and avoids any jamming of the parts of the equipment.

These and other objects and advantages will become apparent upon reading the following description, of which the attached drawings form a part.

DESCRIPTION OF DRAWINGS

FIG. 3 is an elevational side view, partially in cross section, taken in the direction of arrow 3—3 of FIG. 2.

FIG. 4 is a perspective view to an enlarged scale, of the hub portion, and related parts.

FIG. 5 is a framentary, perspective view to an enlarged scale, showing an end of the axle, hub, support plate and impact hammer portions of the apparatus.

FIG. 6 is a fragmentary end view of a modified impact applying system.

DETAILED DESCRIPTION

The apparatus is formed with a wheel-like rotatable frame 10 made of cross-shaped side plates 11 and 12 which are interconnected by numerous slats 13 permanently secured to the plates. The slats may be large enough to form wall surfaces or alternatively additional metal plates may be fastened to the them to form wall surfaces. Together, the slats and adjacent side plate portions define compartments 14.

Figure 2:
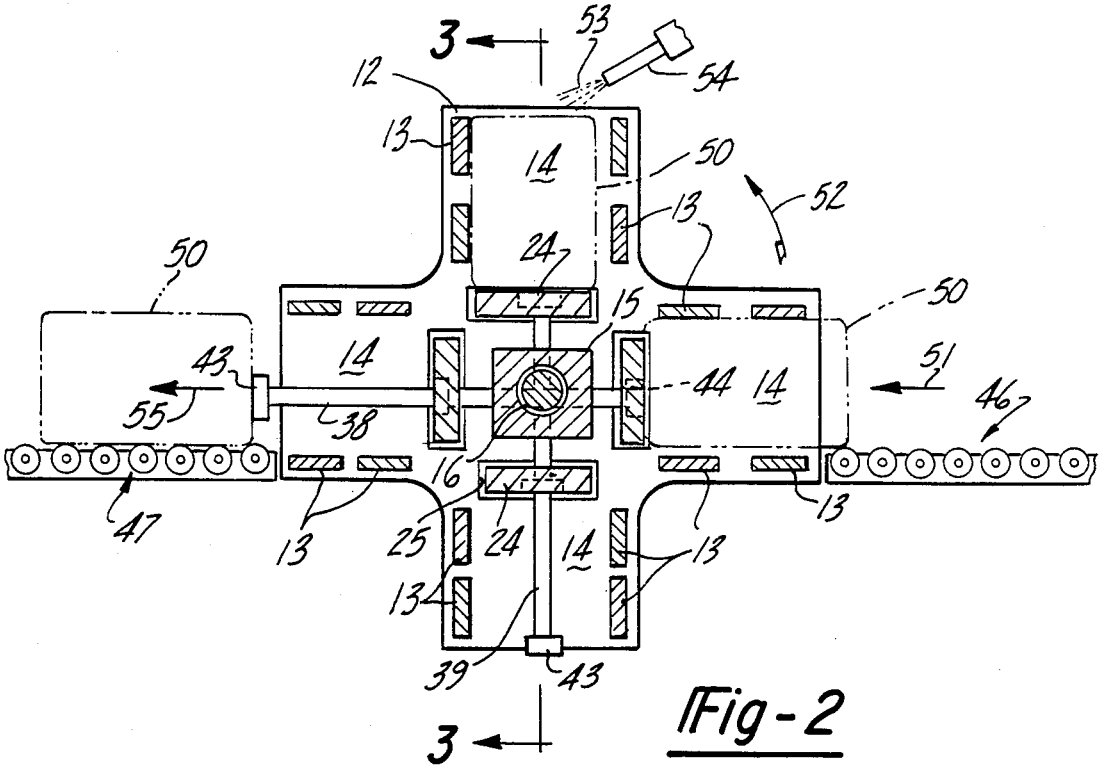
FIG. 2 is an elevational, cross sectional view taken in the direction of arrows 2—2 of FIG. 1.

The compartments 14 are offset 90° relative to each other so that there are two pair of opposing compartments, as indicated in FIG. 2. Each compartment is of a size to receive a casting.

The frame includes a hub 15 which may be formed solid or may be fabricated of separate plates which are welded or bolted together. For illustration purposes, the hub is shown as a solid member. An axle is formed by shafts 16 engaged within sockets 17 formed in the opposite ends of the hub. Alternatively, a single shaft can be used to extend throughout the entire length of the hub.

The free ends of the shafts or axle are rotatably supported within end bearings 18 which are secured upon vertical support posts 19. The lower ends of the posts are fastened upon a suitable support base or ground 20, which is schematically shown (See FIG. 3).

The frame, with its fixed hub and the axle formed of the shafts rotate as a single unit in a manner to be described below.

A loose, support plate 24 is arranged within each compartment close to, and parallel to the hub. The ends of the plate extend through enlarged slots 25 formed in the side plates 11 and 12.

The support plates are mounted upon coils springs 26 which are fastened into coil spring sockets 27 on the hub so that the plates may vibrate or move relative to the hub. Each plate has an end portion 28 extending outwardly of its adjacent frame side plate. A heavy, impact resistant, anvil block 29 is secured upon the end portion of each of the plates 25.

A conventional pneumatic or hydraulic hammering machine 30 is located so that its hammer rod 31 moves up and down against the anvil block 29 of the uppermost, horizontally arranged support plate. The hammer rod is connected to a piston 32 contained within a cylinder 33 that may be hydraulically or pneumatically operated for causing the hammer rod to rapidly move up and down at some predetermined speeds. Hammer machines of this sort are available and, therefore, no further description thereof is given here.

The hammer machine cylinder is secured to an arm 34 which, in turn is connected through a swivel joint 35 to the top of one of the posts 19. Thus, the hammer can be swung into position, over the anvil block, in normal use. Alternatively it can be swung out of position for repair or maintenance, etc.

Elongated push rods 38 and 39 extend through openings 40 and 41 in the hub into the opposed pairs of compartments. The rods may move through guide rollers or journal bearings built into the hub to assist in the endwise movement of the push rods. For illustration purposes, the rods are shown as merely sliding through the respective openings 40 and 41 formed in the hub. Each push rod rod has an enlarged head 43 and its adjacent loose support plate may have a socket 44 or similar space to accommodate the head flush with or below the surface of the plate.

Suitable conveyors 46 and 47 are arranged on the opposite ends of the frame for moving castings, such as engine blocks, to an from the frame. By way of example, conventional roller conveyors are shown. Castings, such as typical engine castings are illustrated in dotted lines 50, in FIG. 2, moving upon the conveyors and into and out of the frame compartments.

Figure 1:
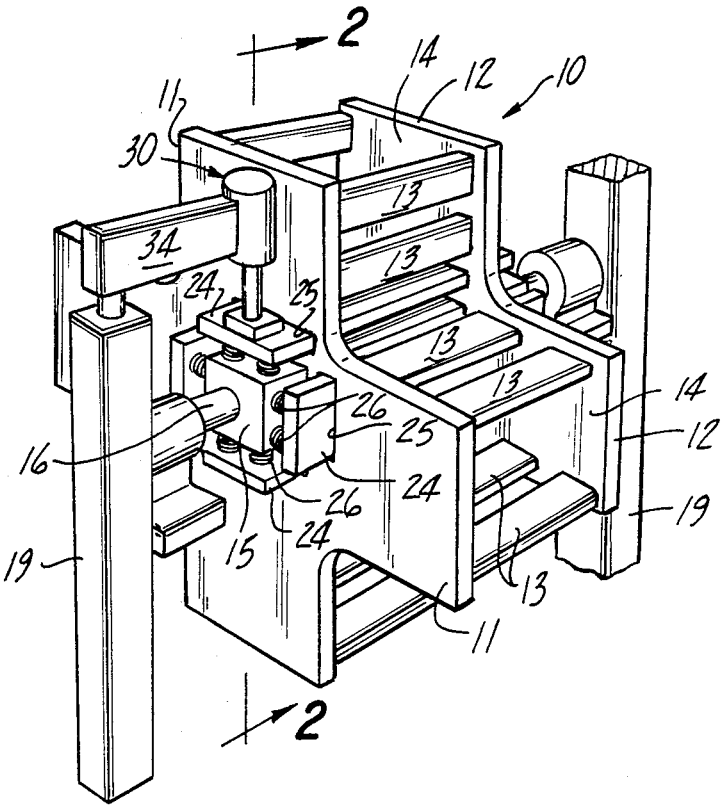
FIG. 1 is a perspective, schematic view of the apparatus of this invention.

In operation, the frame is initially positioned, as shown in FIGS. 1 and 2, with the opposed pairs of compartments either horizontal or vertical. The casting which has been removed from the sand cast mold, travels along the conveyor 46 and into the horizontally arranged casting in front of it. This is indicated by the arrow 51 shown in FIG. 2. When the casting is fully within the compartment, the wheel-like frame is rotated 90° so that the compartment containing the casting is now above the axle and is vertically arranged. At this point, the casting 50 rests upon the loose support plate 24 in the uppermost compartment. Rotation is accomplished by a conventional motor (illustrated) which is connected to one end of the axle and is timed to operate in a stop and rotate cycle.

The hammer machine is operated, at this point, to rapidly impact the anvil block 29 which causes the plate to vibrate and to transmit the forces of impact over a widespread area of the casting. The amount of impacts and the intensity or force produced by the impacts can be varied by trial and error depending upon the particular casting and the type and amount of debris to be loosened.

During the time that the hammer is operated, the casting may be subjected to a blast 53 of high pressure air of fluid from a suitable nozzle 54 connected to a source of fluid or compressed air. The nozzle can be arranged in a location where it has the greatest effect in blowing away the debris or alternatively, a number of nozzles can be used for that purpose.

After a predetermined time sufficient to loosen the debris and blow much of it away, the frame is again rotated 90° so that the uppermost compartment, in which the casting was located, is now arranged in the horizontal removal position. As indicated by the arrow 55, the casting is moved out of the compartment and along the conveyor 47 to the next operating station in the manufacturing line.

In order to assist in removal of the castings from the frame, each incoming casting pushes against the enlarged head 43 of the push rod 38 or 39 in its compartment so that the push rod moves endwise into the opposing compartment. The endwise movement causes the push rod to shove the casting, which is located in the horizontal removal position, out of its compartment and upon the conveyor 47.

As can be seen in FIG. 2, the push rods are relatively loose. Thus, when the compartments are in vertical alignment, their push rod simply stays down so that upon the next rotation of 90°, the downwardly extending push rod is now in position to immediately contact the incoming casting and move endwise into the opposing compartment.

The apparatus described herein may be used individually as a machine to loosen and remove debris from castings. Alternatively, it may be contained in a line of machines, including other debris or sand removing machines, when this machine functions to loosen and remove some of the debris for initially cleaning.

FIG. 6 illustrates an impact system in which each of the support plates has its own impactor or hammer machine, rather than using a single hammer machine. Here, each support plate 24 has a vibrator or hammer machine 60, secured by a mounting plate 61 upon the end of the support plate. The hammer machines 60 can be pneumatic or electrically powered, with suitable controls to operate them when they are in the top position.

Having fully described an operative embodiment of this invention we now claim:

1. A machine for repeatedly impacting a casting for cleaning debris from the casting, comprising:

a horizontally arranged flat plate supported upon springs;

means for positioning and rotating a casting upon and removing a casting from said plate, said means including said plate forming the bottom wall of an open top compartment having a pair of side walls, with said compartment being rotatably mounted upon a horizontal axis for rotating the compartment until the plate is vertical and the side walls are horizontal for loading a casting into the compartment, and then rotating the compartment until the plate is horizontal beneath the casting for supporting the casting thereon during impact and for then rotating the casting until the plate is vertical for horizontally removing the casting from the compartment a generally vertically downwardly directed hammer means for applying repeated blows directed to impact against an end portion of the plate for resiliently vibrating the plate and for spreading out and transmitting the forces of the blows through the plate to the casting located upon the plate;

whereby debris, such as sand, clinging to the casting is loosened and removed from the casting.

2. A machine as defined in claim 1 and including an anvil formed on the end portion of the plate for receiving the hammer blows.

3. A machine as defined in claim 1, and including a second compartment having a second plate and side walls arranged diametrically opposite to the first mentioned compartment and both compartments opening radially outwardly of each other relative to the horizontal axis, and both compartments being connected together by a frame means so that they may be rotated together about said axis;

whereby when the compartments are rotated into a position where their plates are vertical, one compartment may be loaded and the other simultaneously unloaded with a casting moved horizontally into an out of the compartments.

4. A machine as defined in claim 3, and including an elongated, endwise slidable bar extending through both plates and into both compartments, so that a horizontally moved casting that is being loaded into one compartment pushes the bar endwise so that it pushes the casting in the other compartment outwardly for unloading.

5. A machine as defined in claim 3, and including the two compartments forming an opposed pair and, including a second pair of opposed compartments, similar to the first pair, connected to the first pair for simultaneous rotation about the axis;

whereby one pair of compartments open horizontally for loading and unloading castings while the other pair of compartments open vertically with the uppermost one containing a casting supported upon its plate which is impacted by the hammer means, while the opposite compartment opens downwardly and is empty of a casting.

6. A machine as defined in claim 5, and including each opposed pair of compartments having an elongated, endwise slidable bar extending between and through them so that a horizontally moved casting that is being loaded into one compartment pushes the bar endwise to push the casting in the other compartment outwardly for unloading.

7. A machine for impact cleaning castings comprising:

a rotatable wheel-like frame mounted for rotation upon a horizontal axle which supports the frame; said frame being divided into four separate, 90° spaced apart compartments which are arranged so that the frame may rotate about its axle to locate two diametrically opposed compartments in a horizontal position on opposite sides of the axle, with the other two opposing compartments in a vertical position, with one above and one below the axle;

each compartment having a spaced apart fixed support which forms a bottom and a top support floor when the compartment is in its horizontal position, and forms vertical walls when the compartment is in its vertical position;

each compartment having a loosely mounted, support plate arranged close, parallel to, and transverse to the radius of the axle, which plate forms a bottom support floor when the compartment is in its vertical position above the axle, and forms an inner, i.e. adjacent to the axle, vertical wall when the compartment is in its horizontal position;

each plate having an end portion which extends beyond the frame in a direction parallel to the axle;

a generally vertically directed hammer means for repeatedly impacting against the end portion of the plate of the compartment located above the axle;

whereby a casting may be horizontally moved into a horizontal compartment upon the fixed support of the compartment, the wheel-like frame may then be rotated so that the casting rests upon the loose plate whose end portion is repeatedly impacted to loosen debris on the casting and permit the debris to be removed and thereafter, the frame may be rotated to locate the casting containing compartment in its horizontal position on the opposite side of the axle for removal from the frame.

8. A construction as defined in claim 7, and with said loose plates each having its opposite end portions mounted upon springs which are carried by a hub-like member mounted upon the axle for rotation therewith, so the plates resiliently move up and down under the impacts from the hammer means.

9. A construction as defined in claim 1, and including an elongated pusher rod extending between and through each opposing pair of compartments, and means endwise movably mounting said rods upon the axle for rotation with their respective compartments;

whereby when a casting is moved into a horizontally located compartment it presses against the rod therein causing the rod to move endwise through the opposing horizontally located compartment for engaging and pushing horizontally out of said opposing compartment any casting contained therein.

10. A machine for repeatedly impacting a casting for cleaning debris for the casting, comprising:

a horizontally arranged flat plate supported upon springs;

means for positioning said plate between first and second positions said means including a horizontal axis;

said plate being mounted upon said axis for rotation between said first and second positions;

means for positioning a casting upon and removing a casting from said plate;

a generally vertically downwardly directed hammer means for applying repeated blows directed to impact against an end portion of the plate for resiliently vibrating the plate and for spreading out and transmitting the forces of the blows through the plate to the casting located upon the plate;

whereby said casting is received by said plate in said first position then rotated to said second position for supporting the casting thereon during the impact and then rotated to said first position for removing said casting from said plate.

11. The machine of claim 10 and the means for positioning said plate between said first and second positions including said plate forming the bottom wall of an open top compartment having a pair of side walls;

in the first position the plate being vertical and the side walls being horizontal for loading a casting into the compartment, and then rotating the compartment to the second position wherein the plate is horizontal beneath the casting for supporting the casting thereon during the hammer impact and for then rotating the casting until the plate is vertical for horizontally removing the casting from the compartment.

12. A machine as defined in claim 11, and including a second compartment having a second plate and side walls arranged diametrically opposite to the first mentioned compartment and both compartments opening radially outwardly of each other relative to the horizontal axis, and both compartments being connected together by a frame means so that they may be rotated together about said axis;

whereby when the compartments are rotated into the first position where their plates are vertical, one compartment may be loaded and the other simultaneously unloaded with a casting moved horizontally into and out of the compartments.

13. A machine as defined in claim 12, and including an elongated, endwise slidable bar extending through both plates and into both compartments, so that a horizontally moved casting that is being loaded into one compartment pushes the bar endwise so that it pushes the casting in the other compartment outwardly for unloading.

14. A machine as defined in claim 12, and including the two compartments forming an opposed pair and, including a second pair of opposed compartments, similar to the first pair, connected to the first pair for simultaneous rotation about the axis;

whereby one pair of compartments open horizontally for loading and unloading castings while the other pair of compartments open vertically with the uppermost one containing a casting supported upon its plate which is impacted by the hammer means, while the opposite compartment opens downwardly and is empty of a casting.

15. A machine as defined in claim 14, and including each opposed pair of compartments having an elongated, endwise slidable bar extending between and through them so that a horizontally moved casting that is being loaded into one compartment pushes the bar endwise to push the casting in the other compartment outwardly for unloading.

* * * * *

UNITED STATES PATENT AND TRADEMARK OFFICE

CERTIFICATE OF CORRECTION

PATENT NO. : 4,643,243

DATED : February 17, 1987

INVENTOR(S) : Kenneth D. McKibben; Alan P. Gould; Craig J. Groh; Thomas E. Wuepper It is certified that error appears in the above-identified patent and that said Letters Patent is hereby corrected as shown below:

In claim 7, line 18, after "close", add --to--

In claim 10, line 2, delete "for" and add --from--

Signed and Sealed this

Twenty-seventh Day of October, 1987

*Attest:*

DONALD J. QUIGG

*Attesting Officer*

*Commissioner of Patents and Trademarks*